US008943842B2

(12) United States Patent
Street et al.

(10) Patent No.: US 8,943,842 B2
(45) Date of Patent: Feb. 3, 2015

(54) HYBRID PUMPER

(75) Inventors: John Charles Street, Spring, TX (US); Paul Martin Davis, Center Valley, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 28 days.

(21) Appl. No.: 13/499,350

(22) PCT Filed: Oct. 14, 2010

(86) PCT No.: PCT/US2010/052667

§ 371 (c)(1), (2), (4) Date: Mar. 30, 2012

(87) PCT Pub. No.: WO2012/050580

PCT Pub. Date: Apr. 19, 2012

(65) Prior Publication Data

US 2012/0234024 A1 Sep. 20, 2012

(51) Int. Cl.

| | |
|---|---|
| ***F17C 9/02*** | (2006.01) |
| ***F17C 9/04*** | (2006.01) |
| ***F17C 5/06*** | (2006.01) |

(52) U.S. Cl.

CPC ... *F17C 9/04* (2013.01); *F17C 9/02* (2013.01); *F17C 5/06* (2013.01); *F17C 2221/014* (2013.01);

(Continued)

(58) Field of Classification Search

CPC ..... F17C 9/02; F17C 9/04; F17C 2227/0309; F17C 2227/0323; F17C 222/0316; F17C 2227/0332

USPC ..... 62/50.2, 50.3, 50.4

See application file for complete search history.

(56) References Cited

U.S. PATENT DOCUMENTS

| | | | | |
|---|---|---|---|---|
| 2,676,467 | A | 4/1954 | Morrison | |
| 4,033,135 | A * | 7/1977 | Mandrin | 60/648 |

(Continued)

FOREIGN PATENT DOCUMENTS

| | | |
|---|---|---|
| DE | 2506333 A1 | 8/1976 |
| DE | 2749903 A1 | 5/1979 |

(Continued)

OTHER PUBLICATIONS

NPL "Controlling Shell and Tube Exchangers" by Walter Driedger 2000, first published Mar. 1998 http://www.driedger.ca/ce3_stx/CE3_STX.html.*

European Patent Office; International Search Report prepared for PCT/US2010/052667; mailed Dec. 23, 2010.

*Primary Examiner* — Frantz Jules
*Assistant Examiner* — Keith Raymond
(74) *Attorney, Agent, or Firm* — Eric J. Schaal

(57) ABSTRACT

A process and apparatus that includes a cryogenic source for providing a cryogenic fluid for vaporization, a cryogenic pump in fluid flow communication with the cryogenic source for increasing the pressure of the cryogenic fluid, an unfired vaporizer coolant circuit 110 in fluid flow communication with the cryogenic pump and adapted to accept the cryogenic fluid to form a heated stream, a direct-fired vaporizer downstream and in fluid flow communication with the unfired vaporizer coolant circuit 110 and adapted to accept the heated stream from the unfired vaporizer coolant circuit to form a superheated stream; and a diesel engine power unit 118 to provide power to the cryogenic pump, the unfired vaporizer coolant circuit 110, and the direct-fired vaporizer.

22 Claims, 4 Drawing Sheets

(52) U.S. Cl.
CPC ... *F17C 2223/0161* (2013.01); *F17C 2223/033* (2013.01); *F17C 2223/046* (2013.01); *F17C 2225/0123* (2013.01); *F17C 2225/035* (2013.01); *F17C 2227/0142* (2013.01); *F17C 2227/015* (2013.01); *F17C 2227/0309* (2013.01); *F17C 2227/0311* (2013.01); *F17C 2227/0316* (2013.01); *F17C 2227/0327* (2013.01); *F17C 2227/0332* (2013.01); *F17C 2227/0393* (2013.01); *F17C 2260/046* (2013.01); *F17C 2265/05* (2013.01); *F17C 2270/05* (2013.01)
USPC ..... 62/50.3; 62/50.2

(56) References Cited

U.S. PATENT DOCUMENTS

| | | | | |
|---|---|---|---|---|
| 5,095,709 | A * | 3/1992 | Billiot | 62/50.3 |
| 5,551,242 | A * | 9/1996 | Loesch et al. | 62/50.3 |
| 5,832,736 | A * | 11/1998 | Yoshioka et al. | 62/225 |
| 2006/0260331 | A1 | 11/2006 | Andreychuk | |
| 2007/0214804 | A1 * | 9/2007 | Hannan et al. | 62/50.2 |

FOREIGN PATENT DOCUMENTS

| | | | |
|---|---|---|---|
| GB | 2002057 | A | 2/1979 |
| JP | 2008519221 | A | 11/2005 |

* cited by examiner

HYBRID PUMPER

BACKGROUND

Pumpers are portable pieces of equipment designed to deliver a cryogenic liquid such as nitrogen, for example, for temporary oilfield and industrial applications. The pumpers transfer nitrogen, for example, typically with a high-pressure positive-displacement pump, through an onboard vaporizer to a customer's piping, well, or other usage point. Pumpers utilize an onboard diesel engine to drive the pump and hydraulic pumps for ancillary circuits.

Nitrogen is delivered and stored in a cryogenic liquid state, and must be vaporized into the gaseous state and warmed for use in most applications. Many common materials become brittle, however, if exposed to cryogenic temperatures. Thus, the nitrogen must be warmed, prior to usage, to prevent unwanted failure or cracking. The original design of the pumpers utilized a direct-fired vaporizer to vaporize and warm the nitrogen.

Pumpers comprising direct-fired vaporizers include a forced-air liquid-fuel burner and a heat exchanger to transfer heat from the combustion gas into a nitrogen stream. The direct-fired vaporizers contact hot combustion gas directly to a high pressure tube bundle containing the cryogenic fluid.

A less common indirect-fired vaporizer may also be used in the pumpers. The less common indirect-fired vaporizers differ from direct-fired vaporizers in that an intermediate heat transfer fluid, typically a water-ethylene glycol stream, which is circulated to transfer heat from the combustion gas into a smaller high pressure heat exchanger tube bundle containing the cryogenic fluid, is used.

Both direct-fired vaporizers and indirect-fired vaporizers utilized in the pumpers are relatively simple and provide high heat exchange rates in a compact unit; however, both units are very fuel inefficient. Moreover, as a result of increasing fuel costs, both units have a very high relative operating cost. Finally, both units may not be utilized in some areas where open flame restrictions are in place.

For a variety of reasons, including, but not limited to, elimination of open flame conditions for work in locations with potentially flammable atmospheres and reduced fuel consumption, pumpers were adapted to use unfired vaporizers. A pumper incorporated with an unfired vaporizer, also referred to as a heat recovery pumper, loads its diesel engine above the power output required for the nitrogen high pressure positive displacement nitrogen pump and captures the heat from the engine coolant and the hydraulic system. Heat recovery pumpers that utilize a water-brake circuit to load the engine may also capture heat from that circuit as well. Often, the heat is also captured from the engine exhaust gas and engine turbo-charge air circuits, and sometimes other smaller heat sources as well. Heat recovery pumpers require a coolant circulation pump to circulate a water-ethylene glycol mixture to transfer heat from all the heat sources listed above into a coolant vaporizer, which houses the high pressure nitrogen heat exchange tube bundle inside a pressurized coolant vessel.

Heat recovery pumpers typically have better fuel efficiency than pumpers with a fired vaporizer, but for a given unit size, the heat recovery pumpers generally yield about half the nitrogen capacity of a direct-fired unit. Further, the heat recovery pumpers are limited to delivering nitrogen at discharge temperatures around 300° F. (149° C.) and at relatively low nitrogen delivery rates. In contrast, a direct-fired pumper is able to deliver nitrogen at high discharge rates or at temperatures around 600° F. (316° C.), which is desirable for certain industrial applications that use nitrogen as a heating medium.

As a result of the drawbacks of pumpers utilizing both fired and unfired vaporizers, the technology was combined. Fired and unfired vaporizer technologies were combined in parallel to form a single dual-mode pumper unit. The dual-mode pumper unit can utilize either the fired vaporizer or the unfired vaporizer at the discretion of the person operating the equipment. The unfired vaporizer is preferable due to its lower fuel consumption and necessary where the open-flame of the fired vaporizer is potentially a hazard, but the fired vaporizer may be used when the desired nitrogen discharge rate or temperature is beyond the capability of the unfired vaporizer.

Thus, there is a need in the art for a pumper unit that is more fuel efficient than conventional direct-fired vaporizers at all operating conditions, is able to provide high discharge temperatures up to 600° F. (316° C.), is able to discharge high flow rates up to 500,000 standard cubic feet per hour (14,158 $nm^3$/hr) at ambient temperature, and is operated in an efficient manner.

SUMMARY

The disclosed embodiments satisfy the need in the art by providing a hybrid-pumper unit that is more fuel efficient than conventional direct-fired vaporizers at all operating conditions, is able to provide high discharge temperatures up to 600° F. (316° C.), is able to discharge high flow rates up to 500,000 standard cubic feet per hour (14,158 $nm^3$/hr) at ambient temperature, and may be operated in a highly efficient manner.

In one embodiment a pumper is disclosed, comprising: a cryogenic source for providing a cryogenic fluid for vaporization; a cryogenic pump in fluid flow communication with the cryogenic source for increasing the pressure of the cryogenic fluid; an unfired vaporizer coolant circuit in fluid flow communication with the cryogenic pump and adapted to accept the cryogenic fluid to form a heated stream; a direct-fired vaporizer downstream and in fluid flow communication with the unfired vaporizer coolant circuit and adapted to accept the heated stream from the unfired vaporizer coolant circuit to form a superheated stream; and a diesel engine power unit to provide power to the cryogenic pump, the unfired vaporizer coolant circuit, and the direct-fired vaporizer.

In another embodiment, a pumper is disclosed, comprising: a cryogenic source for providing a cryogenic fluid for vaporization; a cryogenic pump in fluid flow communication with the cryogenic source for increasing the pressure of the cryogenic fluid; an unfired vaporizer coolant circuit in fluid flow communication with the cryogenic pump and adapted to accept the cryogenic fluid to form a heated stream, the unfired vaporizer coolant circuit comprising a condensing steam heat exchanger adapted to accept a steam stream from an external source for heat exchange with the unfired vaporizer coolant circuit; and a diesel engine power unit to provide power to the cryogenic pump and the unfired vaporizer coolant circuit.

In yet another embodiment, a process for superheating a cryogenic fluid is disclosed, comprising: providing a cryogenic fluid for vaporization; pressurizing the cryogenic fluid; warming the pressurized cryogenic fluid in an unfired vaporizer coolant circuit to form a warm pressurized fluid; and further warming the warmed pressurized fluid in a direct-fired vaporizer positioned downstream and in fluid flow communication with the unfired vaporizer coolant circuit to form a superheated stream.

BRIEF DESCRIPTION OF SEVERAL VIEWS OF THE DRAWINGS

The foregoing summary, as well as the following detailed description of exemplary embodiments, is better understood when read in conjunction with the appended drawings. For the purpose of illustrating embodiments, there is shown in the drawings exemplary constructions; however, the invention is not limited to the specific methods and instrumentalities disclosed. In the drawings.

DETAILED DESCRIPTION

Figure 1:
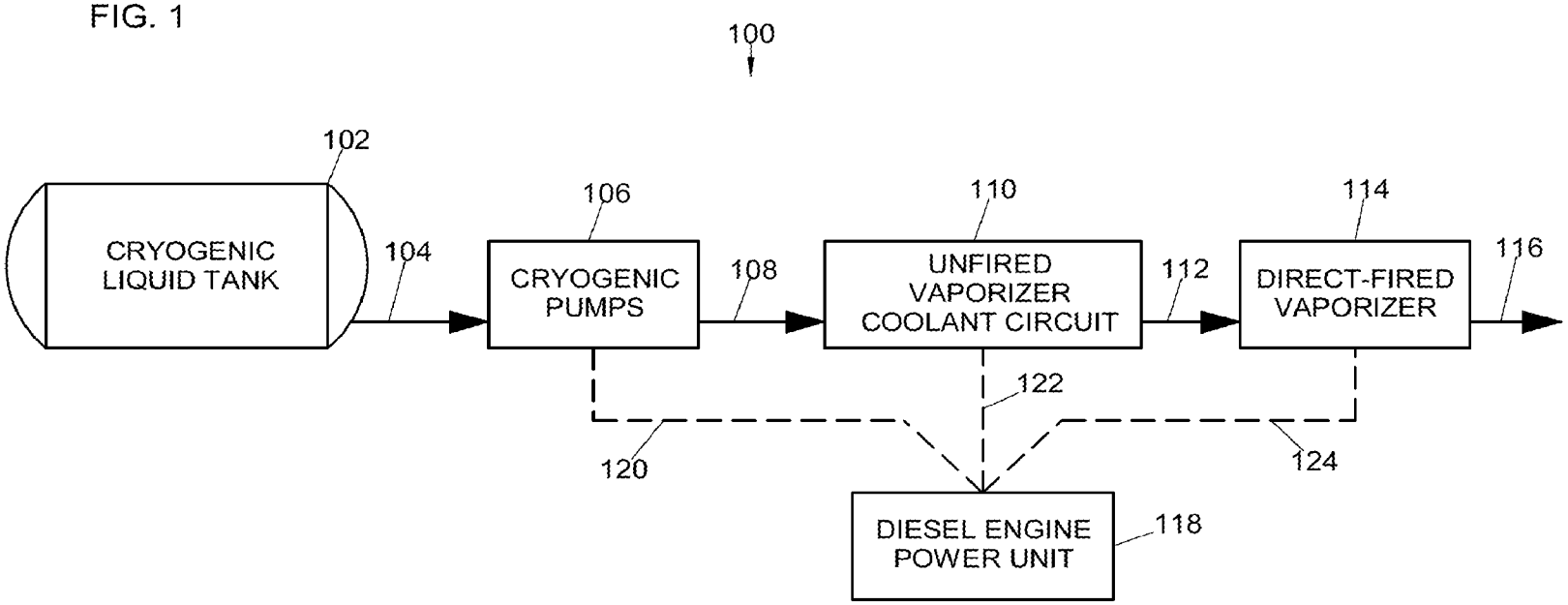
FIG. 1 is flow diagram of an exemplary hybrid pumper in accordance with one embodiment of the present invention.

One embodiment of the current invention concerns a hybrid pumper unit that utilizes the waste heat from the diesel engine used to power the hybrid pumper for vaporization. Such embodiment includes use of an unfired vaporizer installed in series upstream of a direct-fired vaporizer to make operation of the direct-fired vaporizer more efficient. The hybrid pumper also includes an unfired vaporizer coolant circuit, for example that collects waste heat from the diesel engine and transfers the heat to the nitrogen in the unfired vaporizer. Further, heat is captured from the direct-fired vaporizer exhaust stream after the nitrogen heat exchanger bundle and the heat is transferred into the coolant circuit of the unfired vaporizer. The hybrid pumper may also comprise a condensing steam heat exchanger to provide additional heat for the vaporizing nitrogen in the unfired vaporizer coolant circuit when a steam supply is available. The hybrid pumper may also include a control system for operating/maintaining the unfired vaporizer coolant circuit within temperature limitations, and a control system to operate the direct-fired vaporizer to balance heat loads without operator intervention.

In contrast to the heat recovery pumper, the hybrid pumper does not intentionally load the diesel engine via a water brake or hydraulic circuit to create more heat. The engine of the hybrid pumper is much smaller (e.g., a 450 hp or 336 kW engine) than the engine of the heat recovery pumper (e.g., a 750 hp or 559 kW engine) and provides only the shaft power necessary for the nitrogen pumps and ancillary circuits. The hybrid pumper collects heat from the engine coolant, turbo charge air, engine exhaust, and warm oil circuits as well as fired vaporizer combustion exhaust gas and optional supplied steam for warming and vaporizing the nitrogen. Further, the hybrid pumper captures the heat from the engine that would otherwise be released to the atmosphere by traditional direct-fired or indirect-fired nitrogen pumpers.

For those skilled in the art, it is not obvious to sequence nitrogen flow on a pumper first through an unfired vaporizer, then second through a direct-fired vaporizer. For example, one skilled in the art might assume that installing a vaporizer with a lower capacity in series with a vaporizer with a greater capacity would limit the capacity of the circuit to that of the lower capacity vaporizer. Also, one skilled in the art would likely recognize that the latent heat required to vaporize a given mass of liquid nitrogen is nearly the same as the sensible heat required to warm saturated cold nitrogen vapor to ambient temperature. Thus, one skilled in the art might incorrectly conclude that since an upstream vaporizer may have little impact on the temperature of the nitrogen entering the fired vaporizer, it would not improve the efficiency of the direct-fired vaporizer because ice formation will still occur where the heat exchanger tubes contain cold nitrogen vapor.

Applicants found with surprising result, however, that the unfired vaporizer directly improves heat exchange efficiency within the direct-fired vaporizer heat exchanger. Liquid nitrogen often reaches the fired vaporizer of a conventional pumper in a subcooled state. This happens when the discharge pressure from the positive displacement pump is greater than the resulting saturation pressure coincident to the temperature rise of the liquid nitrogen as it is forced through the pumps and piping to the vaporizer. When the direct-fired vaporizer is operating with a nitrogen flow rate that is well below the rated capacity of the direct-fired vaporizer heat exchanger, little pressure differential exists through the parallel heat exchanger tubes to evenly distribute liquid nitrogen through a vertical heat exchange tube distribution manifold that is commonplace for direct-fired vaporizers. This would lead to liquid-vapor phase separation in the vertical heat exchanger tube manifold. The denser liquid nitrogen at the bottom of the manifold would channel through lower heat exchanger tubes. Over time, ice formation on the lower heat exchanger tubes insulates the lower tubes while preferentially channeling combustion gas over the upper tubes. The problem is compounded because friction loss of nitrogen moving through the heat exchanger tubing is lower for a given mass flow rate for a stream of cooler, denser gas than for a warmer, less dense gas. Thus, the mass flow rate in a given tube is commonly higher in the lower tubing than in the upper tubing.

The disclosed sequence of vaporizers improves the direct-fired vaporizer heat exchanger efficiency in the following ways. First, when pressure at the inlet of the fired vaporizer is above the critical pressure of nitrogen, 477.6 psig (32.93 barg), the unfired vaporizer may increase the temperature of the nitrogen stream entering the fired vaporizer until it becomes a supercritical fluid above −232.5° F. (−146.9° C.). Separate liquid and vapor phases cannot exist in a supercritical fluid state, so the nitrogen distribution within the vertical heat exchanger inlet manifold of the fired vaporizer will be more even from top to bottom.

Second, when the pressure at the inlet of the fired vaporizer is below the critical pressure of the nitrogen, the unfired vaporizer may completely vaporize the entire nitrogen stream entering the fired vaporizer, so nitrogen distribution within the vertical heat exchanger inlet manifold of the fired vaporizer will be more even from top to bottom.

Third, when the pressure at the inlet of the fired vaporizer is below the critical pressure of nitrogen, the unfired vaporizer may partially vaporize the nitrogen stream entering the fired vaporizer. Expansion of the nitrogen as it is vaporized from liquid to vapor would create two-phase flow and increase the velocity of the nitrogen entering the fired vaporizer. The turbulence associated with the higher velocity two-phase flow improves nitrogen distribution within the vertical heat exchanger inlet manifold from top to bottom.

The sequence of vaporizers in combination with the fired vaporizer exhaust heat exchanger is especially important because the fired vaporizer is a concurrent heat exchanger. Counter-current heat exchangers are typically more efficient than concurrent heat exchangers when the approach temperature is relatively low, meaning the exiting process fluid temperature is relatively close to the exit temperature of the heating medium. In a generic counter-current heat exchanger, the exit temperature of the heated process fluid can be higher than the exit temperature of the heating fluid if the heat exchanger has sufficient surface area. The same condition cannot occur in a generic concurrent heat exchanger. The approach temperature of a generic concurrent heat exchanger will always be greater than the approach temperature of a counter-current heat exchanger when all other parameters are the same. The heat exchangers for direct-fired vaporizers are almost exclusively concurrent to use the hottest temperature of the combustion gas to control ice formation on the heat exchange tubes close to the liquid nitrogen inlet of the heat exchanger. The sequence of heat exchangers in combination with the addition of a heat exchanger on the direct-fired vaporizer exhaust stream disclosed herein uses the fired vaporizer exhaust gas that has already transferred some of the heat of combustion to the fired vaporizer heat exchanger bundle. The cooler exhaust gas then transfers heat to the coldest nitrogen through a water-ethylene glycol medium, for example. Thus, warmer nitrogen enters the direct-fired vaporizer heat exchanger at the highest combustion temperature. In practical terms, the sequence of unfired and direct-fired vaporizers makes the combined heat exchange more similar to counter-current heat transfer.

Importantly, the combined technologies reduce fuel consumption. Further, and as a result of the reduced fuel consumption, emissions of $NO_x$, CO, and particulate matter are all reduced. Furthermore, the low combustion temperature of direct-fired vaporizers typically produces much less $NO_x$ per pound of fuel compared with current diesel engines, even engines meeting EPA Tier 3 emissions limits. Thus, the hybrid pumper, utilizing a smaller engine in comparison with a heat recovery pumper, is able to deliver a similar nitrogen flow rate as the heat recovery pumper, but is able to produce less $NO_x$ per unit volume of nitrogen delivered. Thus, the hybrid pumper is both an economic and environmental solution.

Pumpers are primarily built for oil and gas field applications. In fact, pumper technology developed as a result of the oil and gas industries. Since steam is typically not available at gas and oil well sites, manufacturers that supply such pumper equipment for oilfield service companies would not consider any method to utilize steam for vaporization. Steam is, however, commonly available at industrial gas and chemical plants/refineries that may require pumpers for temporary nitrogen supply. Use of steam to vaporize cryogenic fluids is common in the industrial gas and chemical plants/refinery industry. Commercial steam vaporizers are available that either directly transfer heat from condensing steam through a heat exchanger tube wall into a cryogenic fluid, or inject steam to heat a water bath with convective circulation while the warm bath transfers heat through heat exchanger tubes into the cryogenic fluid.

While commercial steam vaporizers may be used in conventional pumpers with either fired or unfired vaporizers, the additional cost of installing a condensing-steam vaporizer or a steam-sparged water bath vaporizer with a high pressure tube bundle as a secondary vaporization circuit has traditionally been prohibitive of such incorporation. Furthermore, the size of the steam vaporizer would be particularly difficult to accommodate since the relatively thick wall of the high pressure stainless steel heat exchanger tubing reduces heat transfer and results in much higher heat exchange surface area compared with low pressure thin wall tubing.

Pumpers could also be built that do not use either direct-fired vaporizers or conventional unfired vaporizers utilizing engine heat. Rather, the equipment could use steam as the only source of vaporization without the expenditure of installing other vaporizer circuits. This type of equipment would, however, have narrow utility because it could not be used for many nitrogen pumper applications since it could only be used at locations that can provide the steam. Furthermore, steam supply interruptions would jeopardize the nitrogen vaporization capacity. The direct approach of installing steam vaporizers on nitrogen pumpers has been utilized to an extent in Europe, but has not been adopted as a common practice in the United States due to the drawbacks of both cost and size.

One embodiment of the present invention utilizes a commercially available condensing steam heat exchanger with low pressure thin wall tubing to heat the coolant circuit specific to a conventional pumper with an unfired vaporizer, or specific to a nitrogen pumper that comprises both a fired vaporizer and an unfired vaporizer. The low pressure condensing steam heat exchanger is a fraction of the cost and size of a steam vaporizer with high pressure heat exchange tubing. Utilization of a condensing steam heat exchanger on the coolant circuit of the nitrogen pumper with an unfired vaporizer results in reduced engine fuel consumption because the engine load can be decreased while the latent heat from the condensation of steam displaces heat that would otherwise have to be provided from the engine coolant, engine exhaust, and hydraulic system and/or water brake. Utilization of a condensing steam heat exchanger on the coolant circuit of the nitrogen pumper with both unfired and direct-fired vaporizers can supplement the capacity of the pumper without operating the fired vaporizer.

Some parts of the United States (e.g., California) restrict the use of direct-fired vaporizers by only allowing operation of equipment that has explicit operating permits issued by an air quality district. The districts may also apply additional operating restrictions on the use of such permitted equipment. The hybrid nitrogen pumper, when operated without use of the fired vaporizer, allows services to be provided without operating restrictions in air quality districts that have not issued operating permits for the fired vaporizer. The condensing steam heat exchanger also reduces fired vaporizer fuel consumption while the fired vaporizer is utilized. The steam supply in a refinery is generated, in part, with the use of waste flammable gas streams collected from a flare header for use in boilers. Supplemental heat from a condensing steam heat exchanger in the coolant circuit of a pumper is a compact, cost-effective method to reduce the overall operating cost and emissions while reducing the burden of maintaining a fuel supply for an extended duration. The condensing steam heat exchanger that provides heat to vaporize and warm the nitrogen through the intermediate water-ethylene glycol medium is not as versatile as a steam vaporizer. Steam-sparged water bath vaporizers can heat the nitrogen to slightly warmer temperatures since the water bath can be operated warmer than the unfired vaporizer coolant circuit that must also be used to cool the diesel engine. The water tanks of commercial steam-sparged water bath vaporizers are atmospheric pressure tanks which limit the water bath temperature to the boiling point of water at atmospheric pressure, 212° F. (100° C.) at sea level.

Condensing steam vaporizers can heat nitrogen to temperatures warmer than both steam-sparged water bath vaporizers and the approach using a condensing steam heat exchanger since the steam pressure inside the condensing steam vaporizer shell increases the temperature at which steam condenses into water. However, the condensing steam heat exchanger is economically justifiable on nitrogen pumpers, whereas a steam vaporizer is not. The condensing steam heat exchanger used on the hybrid pumper provides the benefits of increased nitrogen pumper vaporization capacity when the fired vaporizer is not used; and reduced pumper fuel consumption when the fired vaporizer is used for some applications, dependent on nitrogen discharge flow rate and temperature.

The hybrid dual-mode pumper unit may also include a control system or mechanism for assisting with efficient performance. Such control system may include processors, memory devices, input devices, for example, keyboards, touch screens, etc. and output devices such as monitors, printers, etc. that control or interact with: (1) a sensor or detector to determine and/or monitor the temperature of the nitrogen as it exits the fired vaporizer to control combustion fuel rate; (2) a sensor or detector to determine and/or monitor the temperature of the nitrogen as it exits the pumper unit to control the relative fraction of the nitrogen bypassing the vaporizers for final temperature control; (3) a sensor or detector to determine and/or monitor the temperature of the coolant circuit to control the rate of nitrogen entering the coolant vaporizer, the fraction of combustion exhaust gas directed to the fired vaporizer exhaust heat exchanger, and the rate of steam entering the condensing-steam heat exchanger; (4) a sensor or detector to determine and/or monitor the pressure drop across the coolant vaporizer and nitrogen inlet control valve to allow liquid nitrogen to bypass directly to the fired vaporizer by either differential pressure measurement and feedback control to a bypass control valve or check valve with high cracking pressure; (5) thermostatic valves to balance the heat transfer from hydraulic and/or lubricating oil circuits; (6) thermostatic valves to efficiently release excess heat in the coolant circuit to the engine radiator; and (7) shutdowns and overpressure protection for coolant reservoir and/or heat exchanger shells in the event of coolant circuit control failure. The control system may also control or interact with (8) an oversized engine radiator to accommodate heat transfer from engine exhaust and turbo charge air when heat is not utilized in the coolant vaporizer; (9) a liquid aftercooler, followed by air-to-air charge air cooling typical for EPA Tier 3 engine designs; and (10) a charge air water separator to accommodate air intake manifold temperatures that are lower than typical for the engine design FIG. 1 illustrates a hybrid pumper 100 in accordance with one embodiment of the present invention. The hybrid pumper 100 of FIG. 1 comprises a supply tank 102 that stores and provides cryogenic liquid (e.g. liquid nitrogen, liquid argon, etc.) through conduit 104 to cryogenic pumps 106. The cryogenic pumps 106 are in fluid flow communication with the supply tank 102. For brevity, Applicants will refer to the cryogenic liquid in the exemplary embodiments as liquid nitrogen, however, it should be noted that use of the term liquid nitrogen herein should not be construed to limit the disclosure by Applicants. For example, the cryogenic liquid may be liquid argon, for example. Further, as used herein, "in fluid flow communication" means operatively connected by one or more conduits, lines, manifolds, valves and the like, for transfer of fluid. A conduit is any pipe, line, tube, passageway or the like, through which a fluid (liquid or gas) may be conveyed. An intermediate device, such as a pump, compressor or vessel may be present between a first device in fluid flow communication with a second device unless explicitly stated otherwise.

The cryogenic pumps 106 often comprise a centrifugal pump to raise net positive suction head available and a high pressure positive displacement reciprocating pump. The nitrogen is then pumped as a cryogenic liquid through conduit 108 to an unfired vaporizer coolant circuit 110 that vaporizes a fraction or the entire nitrogen stream depending on the nitrogen flow rate and the temperature of the heat sources to form a warmed or heated stream. For the purposes of this application, "unfired vaporizer coolant circuit" refers to the coolant circuit that utilizes a water-ethylene glycol coolant, for example, to provide engine cooling and to transfer heat to the cryogenic fluid. For clarity, the water-ethylene glycol coolant is an exemplary coolant/fluid used to warm the nitrogen. The water-ethylene glycol coolant may be exchanged with other similar coolants, including, but not limited to, pure water, propylene-glycol, and water-propylene glycol. The warmed or heated nitrogen stream exiting the unfired vaporizer coolant circuit 110 then passes through conduit 112 to the direct-fired vaporizer 114 to raise the nitrogen stream temperature to the desired temperature. The nitrogen is discharged from the pumper 100 via conduit 116 as a superheated stream to then satisfy the customer requirement. The cryogenic pumps 106, unfired vaporizer coolant circuit 110, and direct-fired vaporizer are powered by a diesel engine power unit 118 via power transmission lines 120, 122, 124.

Pumpers typically use a hydraulic pump driven from a diesel engine to provide power to operate circuits not detailed in the drawings, including, but not limited to, centrifugal liquid nitrogen pumps, air blowers for fired vaporizer combustion, and fuel pumps. A pressurized lubricating oil system is commonly used for the crankcase of the positive displacement reciprocating liquid nitrogen pump.

Figure 2:
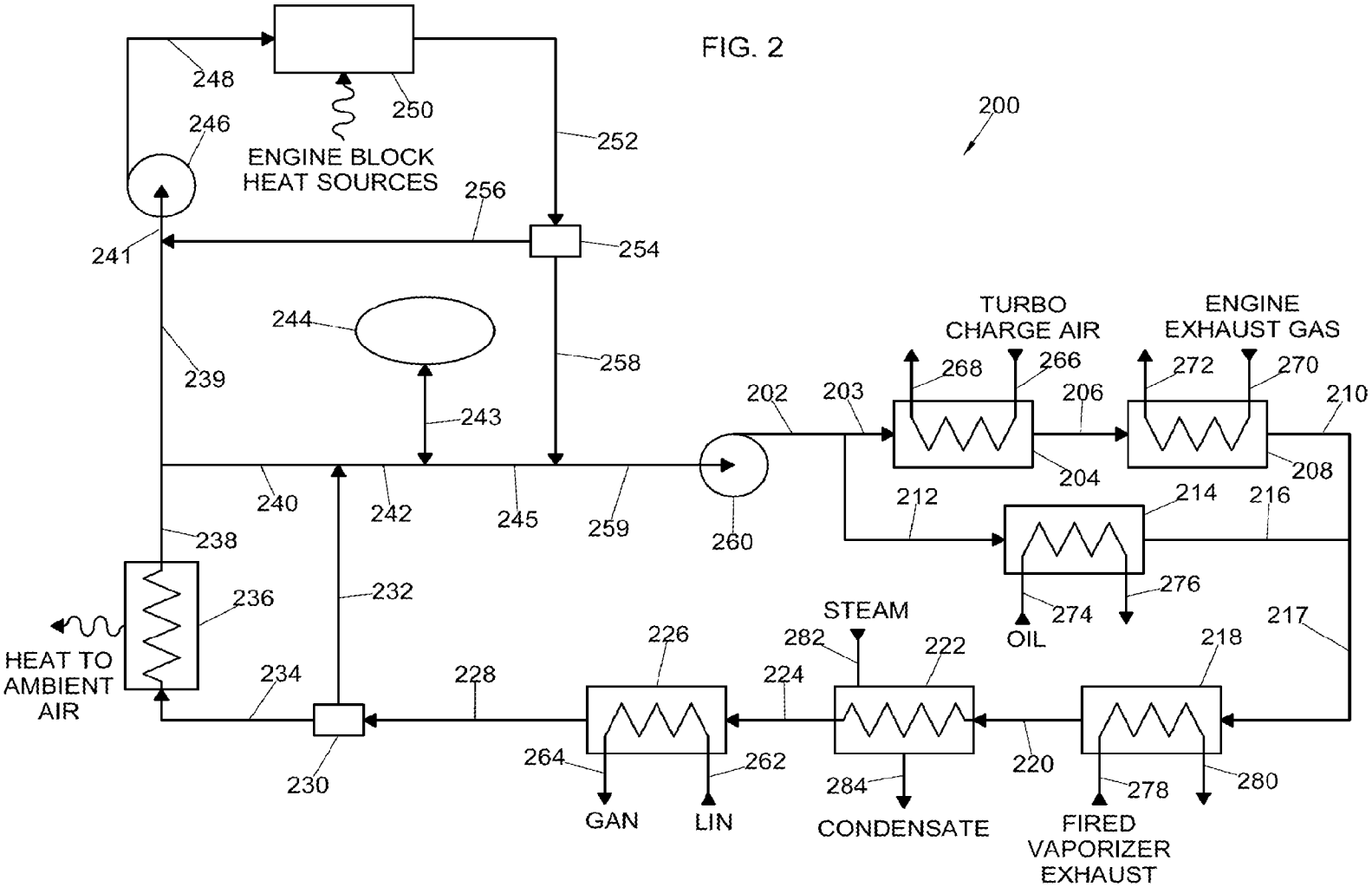
FIG. 2 is a flow diagram of an exemplary unfired vaporizer coolant circuit in accordance with one embodiment of the present invention.

FIG. 2 illustrates an exemplary embodiment of the unfired vaporizer coolant circuit 200 that collects heat from multiple sources and transfers the heat into a liquid nitrogen (LIN) stream 262, for example. A large portion of the unfired vaporizer coolant circuit 200 is circulated via vaporizer coolant circuit pump 260, through conduit 202. A small divided portion of the coolant is split off from conduit 202 via conduit 212 into oil heat exchanger 214. As used herein a "divided portion" of a stream is a portion having the same chemical composition as the stream from which it was taken. Oil heat exchanger 214 removes heat from one or more oil streams (collectively represented by stream 274) including hydraulic power systems and pressurized lubricating oil systems which would otherwise be released to atmosphere through finned oil coolers. The cooled stream 276 then exits oil heat exchanger 214 and returns to the respective oil reservoir or pump to be recirculated. Pressure drop through the oil heat exchanger 214 is balanced by the larger fraction of coolant from the vaporizer coolant circuit pump 260 ported through conduit 203 into the engine charge air heat exchanger 204. Modern diesel engines cool the charge air from the turbocharger to reduce $NO_x$ formation by reducing peak combustion temperature and to increase power density. The high temperature of the engine exhaust stream is wasted heat unless captured. The coolant removes heat from engine charge air stream 266 in the engine charge air heat exchanger 204 and then is fed via conduit 206 into the engine exhaust heat exchanger 208. The cooled engine charge air stream continues through conduit 268 to the engine air intake manifold. The coolant absorbs heat from the engine exhaust stream 270 in the engine exhaust heat exchanger 208. The cooled engine exhaust exits through conduit 272 to a muffler or directly to atmosphere.

The resulting coolant stream from the engine exhaust heat exchanger 208 is then fed via conduit 210 to be mixed with the coolant stream from the oil heat exchanger 214 via conduit 216 into conduit 217. The mixed coolant flows through conduit 217 and into the fired vaporizer exhaust heat exchanger 218 where heat that would otherwise be released to the atmosphere is transferred from the direct-fired vaporizer exhaust stream 278 into the coolant stream. The cooled fired-vaporizer exhaust 280 is discharged to atmosphere. The coolant stream is then transported via conduit 220 from the fired vaporizer exhaust heat exchanger 218 into the condensing steam heat exchanger 222 where the supplied steam 282 condenses and transfers latent heat into the coolant. The steam is converted into the liquid phase as it is cooled, and the resulting condensate is discharged via conduit 284. The coolant stream is at its hottest point in the coolant circuit in conduit 224 exiting the condensing steam heat exchanger 222 before entering the coolant vaporizer 226. Inside the coolant vaporizer 226 heat is transferred from the coolant stream through high pressure tubing into the cryogenic liquid nitrogen (LIN) stream 262 to form vaporized nitrogen (GAN) stream 264 for use in the customer's processes. The coolant exits the coolant vaporizer 226 through conduit 228 and enters the coolant thermostatic valve 230. If the coolant stream temperature approaches normal engine operating temperature, the coolant thermostatic valve 230 will proportionally direct a divided portion or the entire coolant stream through conduit 234 and into radiator 236 that is cooled by ambient air forced from a fan on the diesel engine (not shown).

Importantly, the exemplary embodiment described herein does not divert heat from the charge air or engine exhaust away from the unfired vaporizer coolant circuit 200 when the heat is undesirable, but instead increases the heat dissipation capacity of the unfired vaporizer coolant circuit 200 by increasing the size of the engine radiator 236 above the heat dissipation rating of a standard diesel engine power unit, and by increasing the air capacity of the engine fan (not shown) that forces air through the radiator 236.

An alternate coolant circuit design for the unfired vaporizer would divert the engine charge air stream 266 to bypass the engine charge air heat exchanger 204 and divert the engine exhaust stream 270 to bypass the engine exhaust heat exchanger 208 when the heat absorbed cannot be utilized to vaporize nitrogen. This alternative would allow the engine radiator 236 and the associated engine fan (not shown) to be sized according to standard ratings for the diesel engine power unit.

When the coolant stream is much cooler than normal engine operating temperatures, the coolant exiting the coolant thermostatic valve 230 may be directed through radiator bypass conduit 232. The radiator stream 238 and radiator bypass stream 232 then enter the coolant manifold 240. Part or all of the coolant flow into the coolant manifold 240 then flows through the coolant reservoir header 242 where it connects with the coolant reservoir conduit 243. The coolant flow rate through the coolant reservoir conduit 243 is nearly static.

Typically, a minute portion of coolant will flow from the coolant reservoir 244 through the coolant reservoir conduit 243 into the coolant return header 245 as one or multiple small bleed lines from the engine or radiator not indicated in the schematic flow into the coolant reservoir. The small bleeds purge air into the coolant reservoir 244 which is the high point of the coolant system 200 and also heat the coolant in the coolant reservoir 244 to build system coolant vapor pressure. This process increases the net positive suction head available for the coolant pumps 246 and 260 at higher operating temperatures. Temperature fluctuations in the unfired vaporizer coolant circuit 200 will also result in minor net transient flows to and from the coolant reservoir 244 via conduit 243.

The diesel engine power unit (comprised of at least 236, 241, 246, 248, 250, 252, 254, 256, 266, and 270) of the hybrid pumper makes up a portion of the coolant circuit 200. The engine coolant pump 246 increases coolant pressure through conduit 248 into the engine cooling systems 250, including the cylinder liners, heads, turbocharger, air compressor, EGR (exhaust gas recycle) cooler, etc. (collectively not shown). After exiting the engine cooling system 250, the heated coolant is directed via conduit 252 to the engine thermostat 254, where engine thermostat 254 proportionally opens to cool a divided portion of the coolant stream. When the coolant stream from the engine cooling systems 250 and conduit 252 is below normal engine operating temperature, essentially all of the coolant is directed through conduit 256 back to the suction conduit 241 of the engine coolant pump 246. As the coolant temperature approaches or exceeds the operating temperature (e.g., 175° F. (79° C.) to 210° F. (99° C.)), an increasing divided portion of coolant is directed through conduit 258 via thermostat 254 mixing with coolant from the return header 245 into the suction conduit 259 of the vaporizer coolant circuit pump 260.

As this coolant is directed into the larger coolant circuit, coolant is exchanged from the coolant manifold 240 and the radiator stream 238 back to the diesel engine power unit through conduit 239. The larger coolant circuit is cooler than the engine coolant system, thus heat is delivered from the diesel engine power unit and from other sources into the unfired vaporizer coolant circuit 200 to vaporize the cryogenic liquid nitrogen stream 262, and the heat absorbed by the nitrogen cools the unfired vaporizer coolant circuit 200 to provide cooling for the diesel engine power unit.

Figure 3:
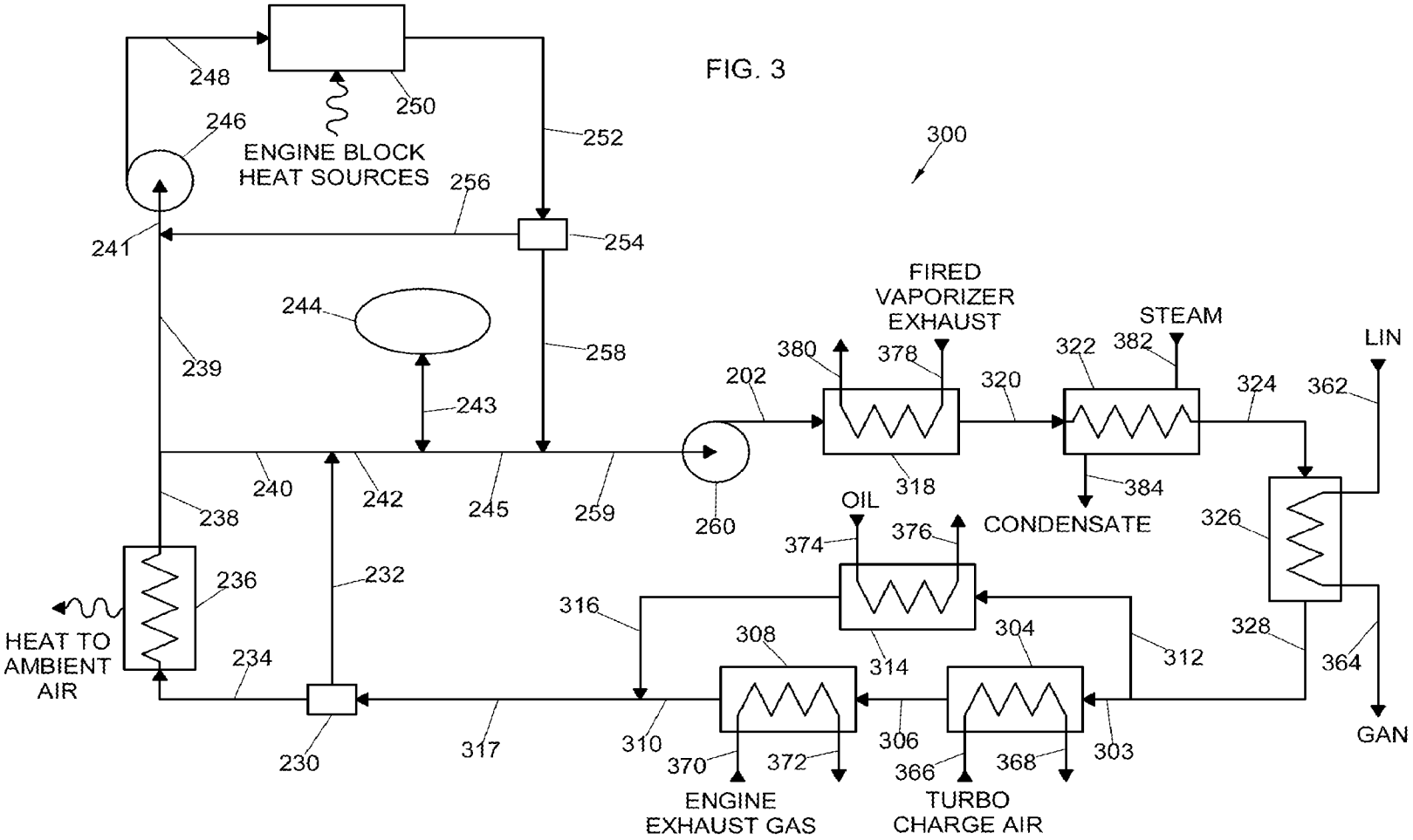
FIG. 3 is flow diagram of an alternative unfired vaporizer coolant circuit disclosed in FIG. 2 in accordance with the present invention.

Unfired vaporizer coolant circuit 300 shown in FIG. 3 is one example of numerous alternative configurations of the heat exchangers of the unfired vaporizer coolant circuit 200. It is important to position the vaporizer coolant circuit pump 260 and the coolant reservoir 244 with respect to the engine coolant pump 246 in a location that will provide little difference in pressure from the coolant reservoir 244 to the suction ports of both pumps 241, 260 to prevent damage to the pumps 246, 260 from cavitation. An optimal design of the unfired vaporizer coolant circuit 300 will arrange the heat exchangers 304, 308, 314, 318, 322, such that those utilizing heating fluids at higher temperatures are positioned in the warmest part of the unfired vaporizer coolant circuit 300 to maximize efficiency, but some practical factors also influence the configuration. The engine exhaust gas 370 is typically hotter than supplied steam circuit 382, engine charge air circuit 366, and hydraulic and lubricating oil circuit 374. Despite the higher temperature of the engine exhaust, the value of simplifying conduit by installing the engine exhaust heat exchanger 308 near the charge air heat exchanger 304 and oil heat exchanger 314 outweighs the maximum efficiency because of lower weight and fewer components. With respect to unfired vaporizer coolant circuit 200, unfired vaporizer coolant circuit 300 is identical in the order of components in the direction of coolant flow from the coolant thermostatic valve 230 to the discharge conduit 202 of the vaporizer coolant circuit pump 260.

Unfired vaporizer coolant circuit 300 differs from unfired vaporizer coolant circuit 200 in the order of the following heat exchangers and interconnecting streams. Coolant from the discharge conduit 202 enters the fired vaporizer exhaust heat exchanger 318, where heat is absorbed from the fired vaporizer exhaust stream 378. The fired vaporizer exhaust stream is discharged to atmosphere through conduit 380, and the coolant is directed to the condensing steam heat exchanger 322 via conduit 320. Within the condensing steam heat exchanger 322, heat is transferred from the supplied steam stream 382 into the coolant stream. Condensate is discharged through conduit 384, and the coolant passes through conduit 324 to the coolant vaporizer 326. The coolant transfers heat in the coolant vaporizer 326 to the entering cryogenic liquid nitrogen stream 362. The cryogenic liquid nitrogen is vaporized and warmed as it absorbs heat from the coolant. The vaporized nitrogen exits through conduit 364. Coolant moves from the coolant vaporizer 326 through conduit 328. A small divided portion of the coolant is split from coolant stream 328 into conduit 312, and enters oil heat exchanger 314. Oil heat exchanger 314 cools the incoming oil stream 374 with the coolant stream. Cooled oil is returned to the oil reservoir (not shown) or oil pump (not shown) through conduit 376. The larger divided portion of coolant stream 328 enters the engine charge air heat exchanger 304 via conduit 303. The coolant absorbs heat from the entering engine turbo charge air 366. The cooled engine turbo charge air exits the engine charge air heat exchanger 304 through conduit 368, where it enters the engine air intake manifold (not shown). Coolant flows from the engine charge air heat exchanger 304 through conduit 306 to the engine exhaust heat exchanger 308, in which heat is absorbed from the engine exhaust stream 370. The cooled engine exhaust exits through conduit 372 to the engine muffler (not shown) or directly to the atmosphere. Coolant exits the engine exhaust heat exchanger through conduit 310 where it joins with the coolant stream 316 from the oil heat exchanger 314. The combined coolant stream 317 flows to the coolant thermostatic valve 230.

Vaporizer coolant circuit 300 may be optimal if it is preferable to position the vaporizer coolant circuit pump 260 closer to the direct-fired vaporizer exhaust heat exchanger 318, or if the pressure rating of the coolant side of a commercial engine exhaust heat exchanger 308 is lower than the discharge pressure of the vaporizer coolant circuit pump 260.

Figure 4:
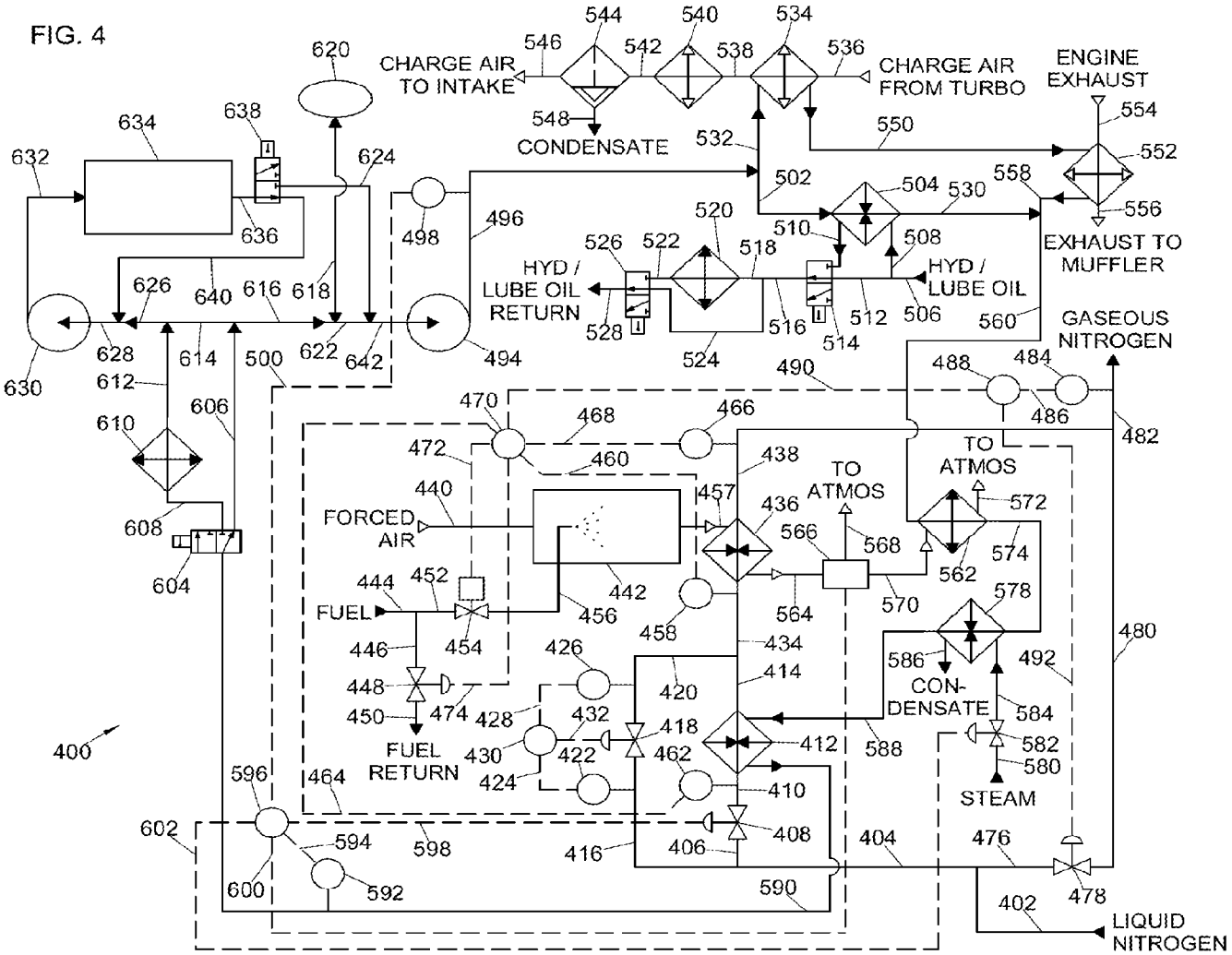
FIG. 4 is a flow diagram of an exemplary unfired vaporizer coolant circuit including a control system in accordance with one embodiment of the present invention.

FIG. 4 illustrates an exemplary unfired vaporizer coolant circuit 400 including a control system in accordance with one embodiment of the present invention. The control system provides automatic control responses to limit the temperature of the unfired vaporizer coolant circuit by reducing heat influx from some of the heat sources. The unfired vaporizer coolant circuit must be cooler than the normal operating temperature of the diesel engine to provide suitable cooling for the engine. Additionally, a lower temperature limit is imposed on the coolant circuit to prevent the water-ethylene glycol coolant mixture from freezing on the surface of the liquid nitrogen coolant vaporizer heat exchanger tubes. The control system also provides an automated system of control for the fired vaporizer to automatically balance heat duty in response to fluctuations in heat provided from the engine circuits due to changes in ambient weather conditions. Devices are indicated to allow ancillary circuits including engine turbo charge air and hydraulic and lubricating oil circuits to have suitable temperature control when cooling cannot be provided by the vaporizer coolant circuit.

Liquid nitrogen is discharged from the cryogenic pumps (not shown) through conduit or line 402. The nitrogen flow is split into a major divided portion through conduit 404 to the vaporizers 412, 436 and a minor divided portion through conduit 476 to the vaporizer bypass control valve 478. The nitrogen to the vaporizers in conduit 404 is split again into primary divided portion through conduit 406 to the coolant vaporizer control valve 408, and secondary divided portion through conduit 416 to the coolant vaporizer bypass valve 418. The nitrogen passing through the coolant vaporizer nitrogen control valve 408 is ported through conduit 410 into the coolant vaporizer 412, where heat is transferred from the coolant stream entering from conduit 588 into the cryogenic liquid nitrogen. The nitrogen bypassing the coolant vaporizer 412 through valve 418 passes through conduit 420. A coolant vaporizer bypass valve controller 430 calculates pressure drop across the coolant vaporizer 412 and the coolant vaporizer nitrogen control valve 408 by subtracting the downstream pressure signal 428 from the upstream pressure signal 424. As used herein, downstream and upstream refer to the intended flow direction of the process fluid transferred. If the intended flow direction of the process fluid is from the first device to the second device, the second device is in downstream fluid flow communication of the first device.

The downstream pressure sensor 426 is common with the pressure in conduit 420, and the upstream pressure sensor 422 is common with the pressure in conduit 416. The coolant vaporizer bypass valve controller 430 sends a proportional signal 432 to the coolant vaporizer bypass valve 418 to throttle the nitrogen to maintain a pressure drop that provides suitable driving force to preferentially feed nitrogen through the coolant vaporizer 412. When the coolant vaporizer nitrogen control valve 408 throttles the incoming nitrogen, the coolant vaporizer bypass valve 418 will respond by opening to maintain the pressure drop. In this description, the pressure drop across the coolant vaporizer is maintained by a control valve, sensors, and a controller to provide positive shutoff of the bypass stream 420 when the coolant vaporizer 412 has ample temperature in the incoming coolant stream 588 to vaporize the entire nitrogen stream, but a simpler method of installing a check valve with a high cracking pressure in place of the control valve, sensors, and controller would provide similar efficiency improvement in the fired vaporizer. Vaporized nitrogen in conduit 414 joins with nitrogen from the coolant vaporizer bypass stream 420 into conduit 434 to the fired vaporizer heat exchanger 436 where heat is provided from the vaporizer combustion gas stream 457.

Forced air conduit 440 from a centrifugal or axial blower enters the fired vaporizer burner 442. Liquid fuel such as kerosene or diesel is delivered into the fired vaporizer burner 442 from conduit 444 from a positive displacement fuel pump (not shown). The fuel conduit branch 446 provides control of pressure on fuel conduit 452 by relieving a divided portion of the fuel stream through fuel pressure control valve 448 to the fuel return conduit 450. Multiple parallel fuel solenoid valves are represented by valve 454. Each fuel solenoid valve 454 is connected to a dedicated fuel conduit 456 which provides fuel at pressure to atomizing nozzles inside the fired vaporizer burner 442, where combustion of the fuel heats the air stream 440. The combustion gas is directed through conduit 457 to the fired vaporizer heat exchanger 436 where heat is transferred through heat exchanger tubing of the fired vaporizer heat exchanger 436 into the nitrogen stream from conduit 434.

The vaporizer exit nitrogen stream 438 contains a temperature sensor 466 which sends the temperature signal 468 to fired vaporizer controller 470. The fired vaporizer controller 470 also receives signals 464 and 460 from the coolant vaporizer inlet temperature sensor 462 and the fired vaporizer inlet temperature sensor 458, respectively. Temperature is measured at the inlet of both vaporizers to provide permissive control logic that will not fire the vaporizer above minimum fuel rate unless cryogenic liquid nitrogen is sensed at either of the two vaporizers. The fired vaporizer controller 470 sends on/off signals 472 to each of the parallel fuel solenoid valves 454 and a proportional signal 474 to the fuel pressure control valve 448. The fired vaporizer controller 470 measures the deviation of the vaporizer exit temperature sensor 466 from the setpoint and responds with adjustments to fuel pressure and the number of nozzles injecting fuel in the burner. The combination and sequence of signals to valves 454 and valve 448 control combustion temperature by manipulating the fuel rate.

The allowable discharge temperature of nitrogen pumpers for industrial applications may range from nearly −300° F. (−184° C.) to greater than 600° F. (316° C.) to accommodate applications where nitrogen is used as a heating or cooling medium. The allowable flow rate is similarly variable, and can operate over a 20:1 range with certain equipment. Direct-fired vaporizers cannot operate continuously with a nitrogen exit temperature that allows ice formation on the heat exchanger tubes at the exit manifold. Also, minimum nitrogen flow rates are often heated above desired discharge temperatures when the direct-fired vaporizer is operated at minimum fuel rate. An application that requires the pumper discharge temperature to be below the minimum operating fired vaporizer exit temperature necessitates the vaporizer bypass control valve 478. Liquid nitrogen passing through vaporizer bypass control valve 478 is delivered through pipe 480 where it cools the temperature of the nitrogen exiting the direct-fired vaporizer 438. The mixed nitrogen stream is delivered through pipe 482 where temperature is sensed by the discharge temperature sensor 484. The sensor signal 486 is communicated to the pumper discharge temperature controller 488, which is user-adjustable and sends a proportional signal 492 to modulate the vaporizer bypass control valve 478. Additionally, the discharge temperature setpoint is communicated by signal 490 to the fired vaporizer controller 470. The fired vaporizer controller 470 will use the setpoint from the discharge temperature controller 488 to control the vaporizer exit temperature at or above the minimum allowable exit temperature.

The section of the control system that represents the coolant circuit is identical to the configuration of unfired vaporizer coolant circuit 200 in FIG. 2, described in detail. Vaporizer coolant circuit pump 494 is a centrifugal pump that increases coolant pressure in the coolant pump discharge stream 496. Pressure sensor 498 on the coolant pump discharge stream 494 is connected to the coolant temperature controller 596 via signal 500. Abnormally low coolant pressure on the coolant pump discharge stream 494 that may be indicative of loss of coolant circulation will cause the devices controlled by the coolant temperature controller 596 to default to fail-safe positions that limit heat transfer into and out of the coolant circuit. Coolant flow from the coolant pump discharge stream 496 is split in two divided portions. The majority of the flow is directed through conduit 532 to the engine charge air heat exchanger 534 and the engine exhaust heat exchanger 552, connected by conduit 550. A smaller fraction of the coolant flow is directed through conduit 502 to the oil heat exchanger 504. Engine exhaust gas 554 from the engine turbocharger (not shown) or a diesel exhaust treatment catalyst (not shown) transfers heat to the coolant stream 550 entering the engine exhaust heat exchanger 552, then exits through conduit 556 to the engine muffler or direct to atmosphere.

The temperature of the unfired vaporizer coolant circuit may normally operate below ambient temperature under some conditions, and at other times the unfired vaporizer coolant circuit may operate above the desired temperature of the engine charge air. Diesel engine manufacturers specify minimum and maximum charge air temperature limits. The maximum temperature limit is intended to keep $NO_x$ emissions within limits that meet EPA non-road regulations. The minimum limit is intended to prevent a significant amount of condensed water from entering the engine intake manifold after the air is compressed and cooled. A section of the engine charge air circuit is indicated in FIG. 4 to mitigate these factors. Conduit 536 shows hot charge air compressed from the engine turbocharger (not shown) ported to the charge air heat exchanger 534. Conduit 538 transfers the charge air to the air-cooled charge air cooler 540 common on many non-road industrial diesel engines meeting EPA Tier 3 emissions limits. The air-cooled charge air cooler 540 is necessary because the charge air heat exchanger 534 does not suitably cool the charge air when the coolant circuit temperature approaches operating temperature of the engine coolant circuit. When operating conditions cool the charge air temperature below the minimum temperature limit specified by the engine manufacturer, some water may condense from water vapor in the ambient air. This water would be carried through conduit 542 into the water separator 544. Low air velocity and changes in the direction of flow in the water separator 544 allows condensate to collect at the bottom where it is discharged through conduit 548 to an automatic float trap (not shown) or similar device that drains the water without discharging compressed air. The charge air exiting the water separator 544 is ported through conduit 546 to the engine intake manifold. The charge air will be below the maximum charge air temperature specified by the engine manufacturer. The charge air may be below the minimum specified charge air temperature, but is suitable for the air intake without condensate. The charge air heat exchanger 534, air-cooled charge air cooler 540, and water separator 544 must all be of a low pressure drop design so that inclusion of the additional components does not exceed the maximum charge air circuit pressure drop specified by the engine manufacturer.

When the engine is running, engine exhaust is continually transferring heat into the unfired vaporizer coolant circuit in the engine exhaust heat exchanger 552. No direct provisions are required to limit the heat transfer from the exhaust gas to the coolant, but the size of radiator 610 and the engine cooling fan (not shown) must be increased to compensate for additional heat that the coolant must dissipate when the coolant vaporizer 412 is not transferring the heat into the nitrogen stream.

The divided portion of the coolant flow in conduit 502 to the oil heat exchanger 504 will remove heat from the oil circuit if the temperature of the coolant circuit is below the maximum permissible operating temperature of the oil. Conduit 506 represents a low-pressure portion of a hydraulic circuit or a lubricating oil circuit return line. The oil flow is split (in divided portions) between conduit 508 to the oil heat exchanger 504 and conduit 512 to bypass the oil heat exchanger 504. Oil exits the oil heat exchanger 504 through conduit 510 and joins with the oil heat exchanger bypass stream 512 inside thermostatic valve 514. This thermostatic valve 514 preferentially diverts cool oil around the oil heat exchanger 504 to prevent high oil viscosity if the coolant circuit temperature is lower than the desired minimum operating temperature of the hydraulic or lubricating oil circuit. A suitable temperature setting of thermostatic valve 514 would be approximately 110° F. (43° C.). The mixed oil leaves thermostatic valve 514 through conduit 516 and is split again for oil cooler 520 via conduits 518 and 524. This oil cooler 520 may be a finned-cooler that will dissipate heat to the atmosphere by natural draft or forced air, and it is necessary when the temperature of the coolant circuit is higher than the maximum permissible operating temperature of the oil. Conduit 518 delivers oil to oil cooler 520, and conduit 524 bypasses oil directly to thermostatic valve 526. Cooled oil exits the oil cooler through conduit 522 and mixes with the bypass oil stream 524 inside thermostatic valve 526. A suitable temperature setting of thermostatic valve 526 may be approximately 150° F. (65° C.). The cooled oil stream 528 returns to the oil reservoir for lubrication oil circuits, open-loop hydraulic circuits, and closed loop hydraulic case drain lines. The cooled oil stream 528 returns to the hydraulic pump in a closed-loop hydraulic circuit. The oil heat exchanger 504, oil cooler 520, thermostats 514, 526, and interconnecting piping can be implemented on both open-loop and closed-loop hydraulic systems.

Coolant from the engine exhaust heat exchanger 552 in conduit 558 joins with coolant stream 530 from the oil cooler 504. The combined coolant continues to the fired vaporizer exhaust heat exchanger 562 through conduit 560. Hot combustion gas can be as high as 800° F. (427° C.) after transferring heat into the fired vaporizer heat exchanger 436. The rate of combustion gas depends on the particular vaporizer design, but is approximately 9,000 cubic feet per minute (255 cubic meters per minute) for an Airco 660K model fired vaporizer. The high rate of combustion gas and potentially high temperature can transfer a tremendous amount of heat into the coolant circuit that cannot be dissipated through the radiator, and must be diverted from the fired vaporizer exhaust heat exchanger 562 under some operating conditions to prevent overheating the engine or boiling coolant in the heat exchanger tubes. Combustion gas is sent through conduit 564 to fired vaporizer exhaust diverter 566. The fired vaporizer exhaust diverter 566 discharges a portion or the entire combustion gas stream directly to atmosphere when necessary via conduit 568. Otherwise, the fired vaporizer exhaust diverter 566 directs the combustion gas through conduit 570 to the fired vaporizer exhaust heat exchanger 562, and then discharges it to atmosphere via conduit 572. The fired vaporizer exhaust diverter 566 is a proportional mechanism that receives a signal 600 from the coolant temperature controller 596. The fired vaporizer exhaust diverter 566 may change the direction of the exhaust gas over a temperature range of 165° F. (74° C.) to 175° F. (79° C.), which is below the temperature of typical modern diesel engine thermostats.

Coolant from the fired vaporizer exhaust heat exchanger 562 is ported to the condensing steam heat exchanger 578 through conduit 574 whenever the hybrid pumper is operating. When steam is supplied through conduit 580, the steam control valve 582 controls the rate of steam flowing through pipe 584 into the shell of the condensing steam heat exchanger 578. Inside the condensing steam heat exchanger 578, steam is liquefied on the coolant tubes and flows by gravity to the bottom of the condensing steam heat exchanger 578, where the steam condensate is discharged through conduit 586 to a steam trap (not shown), in which the condensate is drained, but steam is conserved. The steam pressure inside the condensing steam heat exchanger 578 is the primary control over the rate of heat transferred to the coolant circuit. The steam control valve 582 receives a signal 602 from the coolant temperature controller 596. The heated coolant exits the condensing steam heat exchanger 578 and is transferred through conduit 588 to the coolant vaporizer 412. When cryogenic liquid nitrogen is flowing to the coolant vaporizer 412, the coolant transfers heat through the high pressure tubing into the nitrogen stream.

Coolant exiting the coolant vaporizer 412 flows through conduit 590 where temperature is monitored by the coolant temperature sensor 592. This temperature sensor sends signal 594 to the coolant temperature controller 596. When the coolant temperature approaches the minimum allowable operating temperature between 40° F. (4° C.) and 50° F. (10° C.), controller 596 changes the signal 598 to the coolant vaporizer nitrogen control valve 408 to reduce nitrogen flow through the coolant vaporizer 412 to limit heat removed from the coolant circuit. When the coolant temperature approaches the maximum allowable operating temperature between 165° F. (74° C.) and 175° F. (79° C.), controller 596 adjusts signal 600 to the fired vaporizer exhaust diverter 566 to reduce exhaust gas flow to the fired vaporizer exhaust heat exchanger 562, and controller 596 adjusts signal 602 to steam control valve 582 to reduce the flow of steam into the condensing steam heat exchanger 578, thus limiting heat transferred into the coolant. Coolant from conduit 590 continues to the coolant thermostatic valve 604. This coolant thermostatic valve 604 should be set at approximately 175° F. (79° C.) which is slightly below the temperature at which the diesel engine thermostat opens, but not so low that it will reduce the heat transfer rate in the coolant vaporizer 412. The coolant thermostatic valve 604 sends cool coolant to a radiator bypass stream 606. When the coolant temperature increases, the coolant thermostatic valve 604 directs coolant through conduit 608 to the radiator 610. The radiator provided with a standard diesel engine power unit is neither rated for the additional heat loads from the engine exhaust stream 544, nor from the turbo charge air stream 536 when the heat cannot be used to vaporize nitrogen in coolant vaporizer 412. The radiator 610 on the coolant circuit must be designed to accept these heat loads in addition to the normal engine heat dissipation rating. The coolant stream 612 from the radiator 610 and the radiator bypass stream 606 flow into the coolant manifold 614. The primary flow from the coolant manifold 614 is transferred into the coolant reservoir header 616 which is in communication with the coolant reservoir 620 through conduit 618. The primary flow continues through conduit 622 where a hot coolant stream 624 from the engine thermostat 638 enters and mixes into the coolant circulation pump suction conduit 642.

As coolant from the engine thermostat 638 is directed via conduit 624 into the vaporizer coolant circuit pump suction 642, coolant is exchanged from the cooler coolant manifold 614 and the radiator stream 612 into conduit 626 where the coolant is mixed with hotter engine coolant bypass 640 from the engine thermostat 638 into the suction conduit 628 of the engine coolant pump 630. The engine coolant pump 630 increases pressure of the coolant in conduit 632 to the combined engine cooling systems represented by block 634.

The vaporizer coolant circuit pump 494 is preferred to circulate coolant at a higher rate than the engine coolant pump 630 to prevent coolant from the engine thermostat 638 from bypassing the coolant vaporizer and engine radiator by flowing consecutively through conduits 624, 622, 616, 614, and 626. An example of such equipment utilizing a John Deere 6135HF485 diesel engine with an engine coolant pump 630 capacity of 150 gallons per minute (568 liters per minute) would circulate coolant through the vaporizer circuit from pump 494 at 200 gallons per minute (757 liters per minute).

An example of a fired vaporizer that can be adapted with a vaporizer exhaust diverter 566, fired vaporizer exhaust heat exchanger 562, and a vaporizer automation controller 470 with associated control elements is an Airco/Cryoquip model 660K vaporizer with a fixed speed blower and three parallel fuel solenoid valves 454, each solenoid valve providing fuel to two pressure atomizing nozzles.

The device indicated by coolant temperature controller 596 can be a single device, or can be multiple control devices dedicated to individual control elements. The separate devices indicated by nitrogen discharge temperature controller 488 and fired vaporizer controller 470 can alternatively be combined into a single control device.

EXAMPLES

A hybrid pumper was constructed with a nitrogen process and control system illustrated in FIG. 4, but with an unfired coolant circuit design illustrated in FIG. 3. The diesel engine power unit utilized was a John Deere 13.5L mdl 6135HF485 rated at 450 hp (336 kW). The positive displacement reciprocating triplex cryogenic pump utilized was a Paul/Airco/ACD model 3-LMPD with 2 inch (50.8 mm) stroke and cold ends with 2 inch bore (50.8 mm). Power from the engine was transferred to the triplex pump through an Eaton Fuller RTO-11909MLL automotive manual transmission. The fired vaporizer is an Airco/Cryoquip model 660K vaporizer.

Performance tests were performed during manufacturing at four scenarios of nitrogen discharge rate, temperature, and pressure. The first test scenario was run with a nitrogen flow rate of 216,000 standard cubic feet per hour (6,116 $nm^3$/hr) at discharge conditions of 65° F. (18° C.) and 2,900 psig (200 barg). The second test scenario was run at 231,000 SCFH (6,541 $nm^3$/hr) with 70° F. (21° C.) discharge at 600 psig (41.4 barg). With surprising result, the respective fired vaporizer fuel consumption rates were 15 gallons per hour (56.8 L/hr) and 23 gallons per hour (87.1 L/hr). The estimated fuel consumption rates of an Airco/Cryoquip 660K vaporizer to perform the same conditions without the vaporizer configuration of the hybrid nitrogen pump are 28 gallons per hour (106 L/hr) and 34 gallons per hour (128.7 L/hr) respectively. Including the estimated engine fuel consumption of a Detroit Diesel 8V-92T engine, the vaporizer configuration can be attributed with 30% and 24% reductions in total pumper fuel consumption.

The third test scenario is very similar to operation of a conventional unfired pumper operating at low rate in that the fired vaporizer was not utilized. This test scenario yielded a nitrogen flow rate of 68,900 standard cubic feet per hour (1,951 $nm^3$/hr) at 270 psi (18.6 barg) discharge pressure and 70° F. (21° C.) discharge temperature. The hybrid pumper was able to deliver the nitrogen conditions without the use of the fired vaporizer. In comparison to the estimated vaporizer fuel consumption of an Airco 660K vaporizer installed on a conventional fired pumper, the fuel savings of 11 gallons per hour (41.6 L/hr) demonstrates the reduction in fuel consumption that would be necessary to otherwise use the Airco 660K fired vaporizer. The fuel consumption resulted in an estimated fuel reduction of 58% relative to a model predicting fuel consumption of a fired vaporizer with Airco 660K vaporizer and Detroit Diesel 8V-92T engine.

A fourth test scenario was run with 70 psig (4.8 barg) saturated steam supplied to the condensing steam heat exchanger through three parallel ¾" (DN 20) hoses. The hybrid pumper was operated at a discharge rate of 111,000 SCFH (3,143 $nm^3$/hr) at discharge conditions of 370 psig (25.5 barg) and 100° F. (38° C.). The fired vaporizer was not operated in this scenario. The estimated fuel consumption for an Airco 660K vaporizer to provide the same discharge conditions is 18 gallons per hour (68.1 L/hr). The use of the condensing steam heat exchanger in tandem with heat from the engine yielded an estimated 69% reduction in fuel consumption relative to a nitrogen pumper with an Airco 660K vaporizer and a Detroit Diesel 8V-92T engine.

The following Table 1 illustrates data from all four test scenarios:

TABLE 1

| | Scenario #1 | Scenario #2 | Scenario #3 | Scenario #4 |
|---|---|---|---|---|
| Triplex RPM | 558 rpm | 596 rpm | 178 rpm | 288 rpm |
| Estimated nitrogen flow rate based on 85% pump volumetric efficiency | 216,000 SCFH (6,116 $nm^3$/hr) | 231,000 SCFH (6,541 $nm^3$/hr) | 68,900 SCFH (1,951 $nm^3$/hr) | 111,000 SCFH (3,143 $nm^3$/hr) |
| Approximate ambient temperature | 90° F. (32° C.) | 80° F. (27° C.) | 75° F. (24° C.) | 75° F. (24° C.) |
| Approximate pumper discharge pressure | 2,900 psig (200 bar) | 600 psig (41.4 bar) | 270 psig (18.6 barg) | 370 psig (25.5 barg) |
| Approximate pumper discharge temperature | 65° F. (18° C.) | 70° F. (21° C.) | 70° F. (21° C.) | 100° F. (38° C.) |
| Supplied steam | none | none | none | Three ¾ inch (DN 20) parallel hoses from 70 psig (4.8 barg) saturated supply |
| Approximate engine fuel consumption rate[1] | 14 gal/hr (53.0 L/hr) | 9 gph (34.1 L/hr) | 11 gal/hr (41.6 L/hr) | 5 gal/hr (18.9 L/hr) |
| Estimated Airco 660K vaporizer fuel consumption rate onboard hybrid pumper[2] | 15 gal/hr (56.8 L/hr) | 23 gal/hr (87.1 L/hr) | 0 gal/hr (0.0 L/hr) | 0 gal/hr (0.0 L/hr) |
| Approximate total fuel consumption rate of hybrid pumper | 29 gal/hr (109.8 L/hr) | 32 gal/hr (121.1 L/hr) | 11 gal/hr (41.6 L/hr) | 5 gal/hr (18.9 L/hr) |
| Estimated engine fuel consumption rate of conventional pumper with fired vaporizer[3] | 16 gal/hr (60.6 L/hr) | 11 gal/hr (41.6 L/hr) | 8 gal/hr (30.3 L/hr) | 8 gal/hr (30.3 L/hr) |
| Estimated fuel consumption rate of conventional Airco 660K fired vaporizer[4] | 28 gal/hr (106 L/hr) | 34 gal/hr (128.7 L/hr) | 11 gal/hr (41.6 L/hr) | 18 gal/hr (68.1 L/hr) |
| Estimated total fuel consumption rate of conventional fired pumper | 44 gal/hr (166.6 L/hr) | 45 gal/hr (170.4 L/hr) | 19 gal/hr (71.9 L/hr) | 26 gal/hr (98.4 L/hr) |

TABLE 1-continued

| | Scenario #1 | Scenario #2 | Scenario #3 | Scenario #4 |
|---|---|---|---|---|
| Estimated fuel savings due to vaporizer configuration | 13 gal/hr (49.2 L/hr) | 11 gal/hr (41. 6 L/hr) | 11 gal/hr (41.6 L/hr) | 18 gal/hr (68.1 L/hr)) |
| Estimated reduction in overall fuel consumption due to vaporizer configuration | 30% | 24% | 58% | 69% |

[1]Average reading from engine electronic engine control module display.
[2]Estimated fuel consumption rate based on correlation of fuel nozzle pressure.
[3]Estimated engine fuel consumption rate model based on test data on a Detroit Diesel 8V-92T engine.
[4]Estimated conventional fired vaporizer fuel consumption rate model based on test data on an Airco 660K model vaporizer.

While aspects of the present invention have been described in connection with the preferred embodiments of the various figures, it is to be understood that other similar embodiments may be used or modifications and additions may be made to the described embodiment for performing the same function of the present invention without deviating therefrom. The claimed invention, therefore, should not be limited to any single embodiment, but rather should be construed in breadth and scope in accordance with the appended claims. For example, the following aspects should also be understood to be a part of this disclosure:

Aspect 1. A pumper, comprising:

a. a cryogenic source for providing a cryogenic fluid for vaporization;

b. a cryogenic pump in fluid flow communication with the cryogenic source for increasing the pressure of the cryogenic fluid;

c. an unfired vaporizer coolant circuit in fluid flow communication with the cryogenic pump and adapted to accept the cryogenic fluid to form a heated stream;

d. a direct-fired vaporizer downstream and in fluid flow communication with the unfired vaporizer coolant circuit and adapted to accept the heated stream from the unfired vaporizer coolant circuit to form a superheated stream; and e. a diesel engine power unit to provide power to the cryogenic pump, the unfired vaporizer coolant circuit, and the direct-fired vaporizer.

Aspect 2. The pumper of Aspect 1, further comprising a heat exchanger adapted to accept an exhaust gas stream from the direct-fired vaporizer and a water-ethylene glycol coolant from the unfired vaporizer coolant circuit, wherein the exhaust gas stream from the direct-fired vaporizer is heat exchanged with the water-ethylene glycol coolant.

Aspect 3. The pumper of Aspects 1 or 2, wherein the unfired vaporizer coolant circuit comprises a condensing steam heat exchanger adapted to accept a steam stream from an external source for heat exchange with the cryogenic fluid through the water-ethylene glycol coolant.

Aspect 4. The pumper of any one of Aspects 1 to 3, further comprising a control system adapted to control the temperature of at least the unfired vaporizer coolant circuit.

Aspect 5. The pumper of any one of Aspects 1 to 4, wherein the cryogenic fluid is nitrogen.

Aspect 6. A pumper, comprising:

a. a cryogenic source for providing a cryogenic fluid for vaporization;

b. a cryogenic pump in fluid flow communication with the cryogenic source for increasing the pressure of the cryogenic fluid;

c. an unfired vaporizer coolant circuit in fluid flow communication with the cryogenic pump and adapted to accept the cryogenic fluid to form a heated stream, the unfired vaporizer coolant circuit comprising a condensing steam heat exchanger adapted to accept a steam stream from an external source for heat exchange with the unfired vaporizer coolant circuit; and d. a diesel engine power unit to provide power to the cryogenic pump and the unfired vaporizer coolant circuit.

Aspect 7. The pumper of Aspect 6, further comprising a direct-fired vaporizer downstream and in fluid flow communication with the unfired vaporizer coolant circuit and adapted to accept the heated stream from the unfired vaporizer coolant circuit to produce a superheated stream.

Aspect 8. The pumper of Aspect 7, further comprising a heat exchanger adapted to accept an exhaust gas stream from the direct-fired vaporizer and a water-ethylene glycol coolant from the unfired vaporizer coolant circuit, wherein the exhaust gas stream from the direct-fired vaporizer is heat exchanged with the water-ethylene glycol coolant.

Aspect 9. The pumper of any one of Aspects 6 to 8, further comprising a control system adapted to control the temperature of at least the unfired vaporizer coolant circuit.

Aspect 10. The pumper of any one of Aspects 6 to 9, wherein the cryogenic fluid is nitrogen.

Aspect 11. A process for superheating a cryogenic fluid, comprising:

a. providing a cryogenic fluid for vaporization;

a. pressurizing the cryogenic fluid;

b. warming the pressurized cryogenic fluid in an unfired vaporizer coolant circuit to form a warm pressurized fluid; and c. further warming the warmed pressurized fluid in a direct-fired vaporizer positioned downstream and in fluid flow communication with the unfired vaporizer coolant circuit to form a superheated stream.

Aspect 12. The process of Aspect 11 or 14, further comprising heat exchanging an exhaust gas stream from the direct-fired vaporizer and a water-ethylene glycol coolant from the unfired vaporizer coolant circuit to warm the water-ethylene glycol coolant.

Aspect 13. The process of Aspect 12, wherein the warmed water-ethylene glycol coolant is used to warm the pressurized cryogenic fluid.

Aspect 14. The process of Aspect 11 or 12, further comprising heat exchanging a steam stream from an external source with the water-ethylene glycol coolant to warm the water-ethylene glycol coolant.

Aspect 15. The process of Aspect 14, wherein the warmed water-ethylene glycol coolant is used to warm the pressurized cryogenic fluid.

Aspect 16. The process of any one of Aspects 11 to 15 further comprising monitoring at least the unfired vaporizer coolant circuit to control the temperature of the water-ethylene glycol coolant.

Aspect 17. The process of any one of Aspects 11 to 16, wherein the cryogenic fluid is nitrogen.

The invention claimed is:

1. A pumper, comprising:

a. a cryogenic source for providing a cryogenic fluid for vaporization;

b. a cryogenic pump in fluid flow communication with the cryogenic source for increasing the pressure of the cryogenic fluid;

c. an unfired vaporizer coolant circuit in fluid flow communication with the cryogenic pump and adapted to accept the cryogenic fluid and discharge the cryogenic fluid as a heated stream;

d. a direct-fired vaporizer downstream and in fluid flow communication with the unfired vaporizer coolant circuit and adapted to accept the heated stream from the unfired vaporizer coolant circuit to form a superheated stream;

e. a heat exchanger adapted to accept an exhaust gas stream from the direct-fired vaporizer and a coolant from the unfired vaporizer coolant circuit, wherein the exhaust gas stream from the direct-fired vaporizer is heat exchanged with the coolant;

f. a diesel engine power unit to provide power to the cryogenic pump, the unfired vaporizer coolant circuit, and the direct-fired vaporizer;

g. a first bypass circuit in fluid flow communication with the cryogenic pump and the superheated stream, thereby enabling a portion of the cryogenic fluid to be mixed with the superheated stream and to bypass the unfired vaporizer coolant circuit and the direct-fired vaporizer;

h. a second bypass circuit in fluid flow communication with the cryogenic PUMP and the heated stream, thereby enabling a portion of the cryogenic fluid to bypass the unfired vaporizer coolant circuit and flow through the direct-fired vaporizer; and i. a control system adapted to control flow of cryogenic fluid through the first and second bypass circuits.

2. The pumper of claim 1, wherein the unfired vaporizer coolant circuit comprises a condensing steam heat exchanger adapted to accept a steam stream from an external source for heat exchange with the cryogenic fluid through the coolant.

3. The pumper of claim 1, wherein the control system is adapted to control the temperature of at least the unfired vaporizer coolant circuit.

4. The pumper of claim 1, wherein the cryogenic fluid is nitrogen.

5. A process for superheating a cryogenic fluid, comprising:

a. providing a cryogenic fluid for vaporization;

b. pressurizing the cryogenic fluid;

c. warming the pressurized cryogenic fluid in an unfired vaporizer coolant circuit to form a warm pressurized fluid;

d. further warming the warmed pressurized fluid in a direct-fired vaporizer positioned downstream and in fluid flow communication with the unfired vaporizer coolant circuit to form a superheated stream;

e. heat exchanging an exhaust gas stream from the direct-fired vaporizer and a coolant from the unfired vaporizer coolant circuit to warm the coolant;

f. selectively enabling at least a first portion of the cryogenic fluid to flow through a first bypass circuit in fluid flow communication with the cryogenic pump and the superheated stream, thereby enabling a portion of the cryogenic fluid to be mixed with the superheated stream and to bypass the unfired vaporizer coolant circuit and the direct-fired vaporizer;

g. selectively enabling at least a second portion of the cryogenic fluid to flow through a second bypass circuit in fluid flow communication with the cryogenic pump and the heated stream, thereby enabling a portion of the cryogenic fluid to bypass the unfired vaporizer coolant circuit and flow through the direct-fired vaporizer; and h. controlling flow of the cryogenic fluid through the first and second bypass circuits.

6. The process of claim 5, further comprising heat exchanging a steam stream from an external source with the coolant to warm the coolant, and warming the pressurized cryogenic fluid with the warmed coolant.

7. The process of claim 5, further comprising monitoring at least the unfired vaporizer coolant circuit to control the temperature of the coolant.

8. The process of claim 5, wherein the cryogenic fluid is nitrogen.

9. The pumper of claim 1, wherein the coolant is a water-ethylene glycol coolant.

10. The pumper of claim 1, wherein the unfired vaporizer coolant circuit comprises a closed loop through which the coolant circulates.

11. The pumper of claim 10, wherein the closed loop comprises at least one conduit that circulates the coolant through an engine cooling system of the diesel engine power unit.

12. The pumper of claim 1, wherein the control system is adapted to monitor at least the unfired vaporizer coolant circuit to control a fraction of the cryogenic fluid that flows through the unfired vaporizer coolant circuit as a function of a temperature of the unfired vaporizer coolant circuit.

13. The process of claim 5, wherein the coolant is an ethylene-glycol coolant.

14. The process of claim 5, further comprising monitoring at least the unfired vaporizer coolant circuit to control a fraction of the pressurized cryogenic fluid that flows through the unfired vaporizer coolant circuit as a function of a temperature of the unfired vaporizer coolant circuit.

15. The process of claim 5, further comprising transferring the coolant in one or more conduits in fluid flow communication to an engine cooling system of the diesel engine power unit to cool the diesel engine power unit and warm the pressurized cryogenic fluid.

16. The process of claim 15, further comprising controlling a temperature of the unfired vaporizer cooling circuit such that the temperature of the unfired vaporizer cooling circuit is less than an operating temperature of the diesel engine power unit and is greater than a temperature at which the coolant freezes within the unfired vaporizer cooling circuit.

17. The pumper of claim 1, wherein the control system is further adapted to control flow of cryogenic fluid through the second bypass circuit as a function of at least a temperature of the unfired vaporizer coolant circuit.

18. The pumper of claim 1, wherein the control system is further adapted to control flow of cryogenic fluid through the second bypass circuit as a function of at least a pressure drop across the unfired vaporizer coolant circuit.

19. The pumper of claim 1, wherein the control system is further adapted to control flow of cryogenic fluid through the first bypass circuit as a function of at least a pumper discharge temperature.

20. The method of claim 5, further comprising:

wherein selectively enabling at least a first portion of the cryogenic fluid to flow through the first bypass circuit is a function of a discharge temperature.

21. The method of claim 5, wherein selectively enabling at least a second portion of the cryogenic fluid to flow through the second bypass circuit is a function of at least a temperature of the unfired vaporizer coolant circuit.

22. The method of claim 5, wherein selectively enabling at least a second portion of the cryogenic fluid to flow through the second bypass circuit is a function of at least a pressure drop across the unfired vaporizer coolant circuit.

* * * * *

UNITED STATES PATENT AND TRADEMARK OFFICE

CERTIFICATE OF CORRECTION

PATENT NO. : 8,943,842 B2
APPLICATION NO. : 13/499350
DATED : February 3, 2015
INVENTOR(S) : John Charles Street and Paul Martin Davis It is certified that error appears in the above-identified patent and that said Letters Patent is hereby corrected as shown below:

In the Claims,

Column 21, Line 37

In claim 1 (h.) delete the word "PUMP" and insert the word -- pump --

Signed and Sealed this
Twenty-second Day of September, 2015

Michelle K. Lee

Michelle K. Lee
*Director of the United States Patent and Trademark Office*